United States Patent [19]

Keilman et al.

[11] Patent Number: 4,508,236

[45] Date of Patent: Apr. 2, 1985

[54] CONTAINER AND ASSOCIATED CAP ASSEMBLY FOR PLASMA COLLECTION AND THE LIKE

[75] Inventors: Michael R. Keilman, Mundelein, Ill.; Richard West, Salem, Wis.

[73] Assignee: Baxter Travenol Laboratories, Inc., Deerfield, Ill.

[21] Appl. No.: 636,075

[22] Filed: Jul. 31, 1984

Related U.S. Application Data

[63] Continuation of Ser. No. 417,728, Sep. 13, 1982.

[51] Int. Cl.[3] ..... B65D 51/16

[52] U.S. Cl. ..... 215/308; 215/309; 215/306; 137/588

[58] Field of Search ..... 215/306, 308, 309, 228, 215/100 R; 137/588, 592; 251/4; 222/530

[56] References Cited

U.S. PATENT DOCUMENTS

| | | | |
|---|---|---|---|
| 255,872 | 7/1980 | Shrine et al. . | |
| 266,017 | 8/1982 | Kellogg . | |
| D. 271,804 | 12/1983 | Momoda . | |
| 596,158 | 12/1897 | Harris | 215/309 |
| 2,138,936 | 12/1938 | Osterberg | 215/309 |
| 2,744,661 | 5/1956 | Davis . | |
| 2,770,234 | 11/1956 | Nesset et al. | 215/308 |
| 2,789,734 | 4/1957 | Biederman . | |
| 2,844,267 | 7/1958 | Petriccione | 215/309 |
| 2,957,614 | 10/1960 | Krajcovic . | |
| 3,059,816 | 10/1962 | Goldstein | 215/309 |
| 3,103,335 | 9/1963 | Martinez | 251/4 |
| 3,160,330 | 12/1964 | Pollitt . | |
| 3,217,928 | 11/1965 | Burbig | 251/4 |
| 3,537,456 | 11/1970 | Harautuneian . | |
| 3,638,834 | 1/1972 | Goodrich et al. . | |
| 3,724,461 | 4/1973 | Eisenberg . | |
| 3,863,817 | 2/1975 | Speaker . | |
| 3,939,623 | 2/1976 | Shrine et al. . | |
| 3,952,902 | 4/1976 | Prouty et al. | 215/306 |
| 3,957,168 | 5/1976 | Shrine et al. . | |
| 3,980,120 | 9/1976 | Kligerman | 222/530 |
| 4,080,989 | 3/1978 | Chapelsky | 215/309 |
| 4,153,173 | 5/1979 | Ward et al. | 215/309 |
| 4,234,095 | 11/1980 | Safianoff . | |
| 4,236,655 | 12/1980 | Humphries . | |
| 4,307,766 | 12/1981 | Tanokura . | |

OTHER PUBLICATIONS

Brochure on Plasmaflex TM Pooling Bottle, manufactured and sold by Terumo Corporation (Japan).

*Primary Examiner*—Joseph Man-Fu Moy
*Assistant Examiner*—David Fidei
*Attorney, Agent, or Firm*—Paul C. Flattery; Daniel D. Ryan

[57] ABSTRACT

A container for pooling plasma and the like has an integral cap. The cap includes an air vent with an inline bacterial filter. The cap also includes a fluid passage to which a length of tubing can be integrally connected to transfer fluid into the container. The transfer tubing can be sealed and severed close to the cap. The cap includes a pocket which receives the remaining sealed end portion of the tubing to protect the sealed end portion from inadvertent contact and damage during subsequent handling. The cap also includes a cover which closes the pocket to further enhance the protection of the sealed tubing end. The cover includes a plug which, when the pocket is closed, hermetically seals the vent and, thus, the entire container.

1 Claim, 11 Drawing Figures

FIG. 1 – PRIOR ART
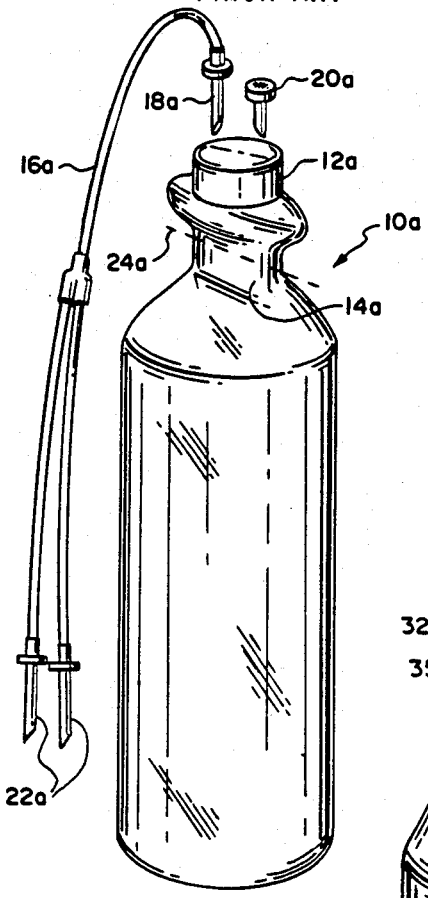
FIG. 2
PRIOR ART
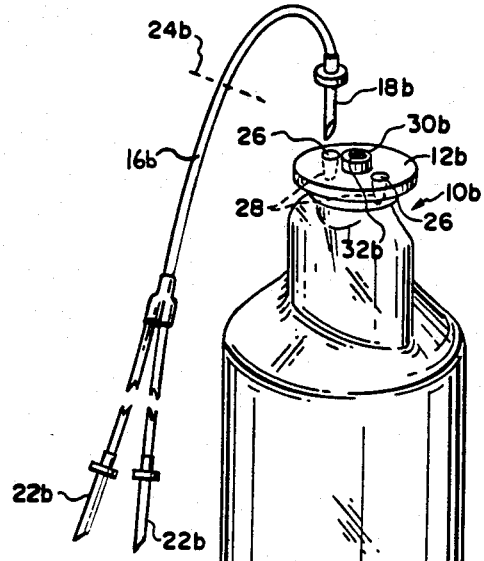
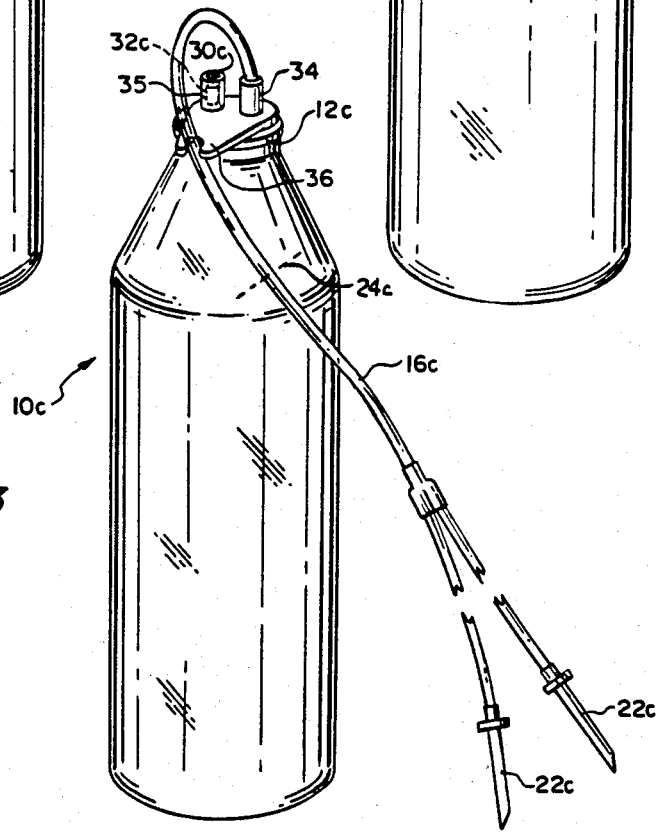
FIG. 3
PRIOR ART

CONTAINER AND ASSOCIATED CAP ASSEMBLY FOR PLASMA COLLECTION AND THE LIKE

This is a continuation of application Ser. No. 417,728, filed Sept. 13, 1982.

FIELD OF THE INVENTION

This invention generally relates to containers for liquid collection and, in particular, to containers for pooling plasma and other parenteral solutions.

THE BACKGROUND AND OBJECTS OF THE INVENTION

Plasmapheresis is a procedure which facilitates the collection of plasma for commercial fractionation into Clotting Factor VIII (also known as AHF), albumin, and other plasma-based protein fractions. During conventional plasmapheresis, a unit of whole blood is collected and separated into red blood cells and plasma. The red blood cells are returned to the donor, and the plasma is retained for fractionation purposes. Another unit of whole blood is then drawn from the same donor and again separated into red blood cells and plasma. Again, the red blood cells are returned to the donor, and only the plasma is retained.

Thus, two units of plasma can be obtained from a donor during a conventional plasmapheresis procedure. The two units of plasma are typically collected, or pooled, in a single container which has been specially designed for this purpose. The pooled plasma is frozen in the container and shipped to a fractionation facility. At the facility, the plasma is thawed and dumped from the container into a vat for fractionation.

A prior art plasma pooling container 1O*a* is shown in FIG. 1. This container 1O*a* is similar to one manufactured and sold by the Fenwal Division of Travenol Laboratories, Inc. (Deerfield, Illinois) as the PLASMAGARD TM Plasma Pooling Bottle. The container lO*a* is manufactured from thermoplastic resins and includes an integral cap 12*a* and a narrow, constricted neck 14*a*. Plasma is transferred into the container 1O*a* by use of a transfer set 16*a* having, at one end, a pointed spike 18*a* which is driven by the user through the cap 12*a*. To enable fluid transfer, a vent tube 20*a* is also driven by the user through the cap 12*a*. A pair of spikes 22*a* is situated at the other end of the transfer set 16*a*. Each spike 22*a* pierces a rupturable diaphragm located in the port of a bag (not shown) in which a unit of whole blood is collected and centrifugally separated into red blood cells and plasma. After the plasma of two collection bags has been pooled in the container 10*a*, the narrow, constricted neck 14*a* is cut generally along the line 24*a* to separate the cap 12*a*. At the same time, the neck 14*a* is sealed closed along the cutting line 24*a* by special heat sealing equipment to provide an air and fluid-tight seal for the container 10*a*.

A similar prior art pooling container (not shown) is disclosed in Shine et al U.S. Pat. No. 3,957,168. See also Shine et al U.S. Pat. No. Des. 255,872.

Another prior art plasma pooling container 10*b* is shown in FIG. 2. This container 10*b* is similar to one manufactured and sold by Alpha Therapeutic Corporation (South Pasadena, California) and is generally disclosed in Safianoff U.S. Pat. No. 4,234,095. Like the container 10*a* just described, the container 10*b* is manufactured from a thermoplastic material and includes an integral cap 12*b*. Unlike the cap 12*a*, the cap 12*b* includes preformed sleeves 26 each of which defines a target for placement of the spike 18*b* associated with the plasma transfer set 16*b*. Each sleeve 26 also includes a preformed cylindrical guide 28 (shown in phantom lines in FIG. 2) which retains the inserted spike 18*b* in a tight interference fit. Also unlike the cap 12*a*, the cap 12*b* includes an integrally formed vent tube 30*b*. In this arrangement, after the plasma is pooled in the container 10*b*, the container 10*b* is closed by sealing and severing the tubing of th.e attached plasma transfer set 16*b* generally along the line 24*b*.

The resulting seal is fluid-tight. However, unlike the container 10*a*, the container 10*b* is not hermetically sealed, because the vent tube 30*b* is never closed. To maintain sterility in this arrangement, the vent tube 30*b* includes a plug 32*b* of sterile fibrous material.

Yet another prior art plasma pooling container 10*c* is shown in FIG. 3. This pooling container 10*c* is similar to one manufactured and sold by Terumo Corporation (Japan) as the PLASMAFLEX TM Pooling Bottle. This container 10*c* is also manufactured from a thermoplastic material and includes an integral cap 12*c*. An end of the transfer set 16*c* is integrally connected to one port 34 in the cap 12*c*, thereby eliminating the need for a spike. A vent tube 30*c* with a bacterial filter 32*c* (shown in phantom lines in FIG. 3) is provided in communication with another port 35 on the cap 12*c*. In this arrangement, the upper portion of the tubing is held relatively stationary by a holder 36. After the plasma has been collected, the upper portion tubing of the transfer set 16*c* is heat sealed closed and severed generally along the line 24*c*.

As with the bottle 10*b*, the resulting seal of the container 10*c* is fluid-tight , but it is not hermetic, because the vent tube 30*c* remains open.

Because the container 10*b* and 10*c* are not completely hermetically sealed, quick and efficient water bath immersion techniques cannot be used to thaw the plasma. Rather, more time-consuming techniques, such as shelf thawing or batch thawing, have to be utilized.

Furthermore, in both of the containers 10*b* and 10*c*, the sealed ends 24*b* and 24*c* of the associated transfer sets 16*b* and 16*c* are exposed to contact throughout freezing, shipping, and thawing operations. This tubing (typically made from a plasticized polyvinyl chloride material) can become brittle during exposure to low temperatures and can thus become even more vulnerable to being inadvertently broken or damaged as a result of contact. Should this occur, the sterile integrity of the frozen contents of the bottle 10*b* or 10*c* is, of course, compromised.

With the foregoing considerations in mind, one of the principal objects of the invention is to provide a plasma pooling container or the like which serves to shield or protect the sealed end portion of associated tubing from being inadvertently broken or damaged during handling, thereby assuring that the sterile integrity of its contents is not compromised.

Another principal object of this invention is to provide a plasma pooling container or the like which can be hermetically sealed, thereby allowing complete water bath immersion of the container, if desired.

SUMMARY OF THE INVENTION

To achieve these and other objects, the invention provides a container assembly suited for the collection of plasma and other parenteral solutions. The container assembly includes an attached cap assembly which comprises a body through which a fluid path extends. The cap assembly also includes means for attaching a length of tubing, such as one associated with a fluid transfer set, to the body in communication with the fluid path.

In accordance with one aspect of the invention, the cap assembly further includes means which defines a pocket in the body for therein selectively enclosing an end portion of the attached tubing after the end portion has been sealed closed to retain transferred fluids in the container.

Being enclosed in the pocket, the sealed end portion of the tubing is shielded from inadvertent contact, which can break or otherwise damage the end portion and compromise the sterile integrity of the contents of the container.

In one embodiment, the cap assembly further includes cover means which is operative for movement relative to the body between a first position, which opens the pocket, and a second position, which closes the pocket.

With the cover means in its second position, the sealed end portion of the tubing is completely shielded from contact in the pocket.

In accordance with another aspect of the invention, the cap assembly also includes vent means. In this arrangement, when the cover means is in its second position, it serves, not only to close the pocket, but also to hermetically close the vent means and, thus, the container assembly as well.

Other features and advantages of the invention will be pointed out in, or will be apparent from, the specification and claims, as will obvious modification of the embodiments shown in the drawings.

DESCRIPTION OF THE DRAWINGS

FIGS. 1 through 3 are view of prior art plasma pooling bottles;

Before explaining the embodiments of the invention in detail, it is to be understood that the invention is not limited in this application to the details of construction and the arrangement of components as set forth in the following description or as illustrated in the accompanying drawings. The invention is capable of other embodiments and of being practiced or carried out in various ways. Furthermore, it is to be understood that the phraseology and terminology employed herein is for the purpose of description and should not be regarded as limiting.

DESCRIPTION OF THE PREFERRED EMBODIMENT

Figure 4:
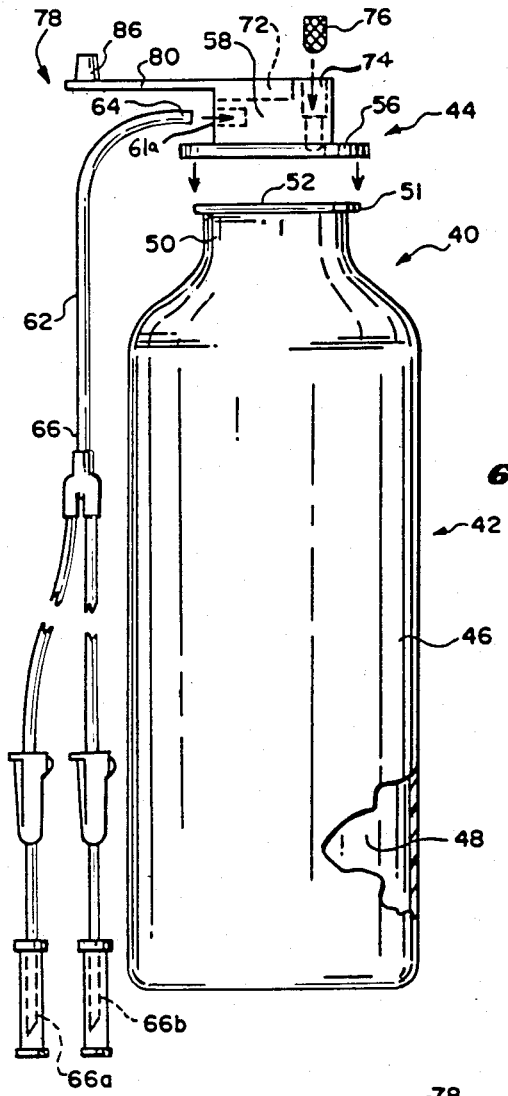
FIG. 4 is an exploded view, with a portion broken away and in section, of a container assembly which can also be used as a plasma pooling bottle and which embodies the features of the invention.

A container assembly 40 which embodies the features of the invention is shown in FIG. 4. The assembly 40 includes a container 42 and a cap assembly 44 which is attached to the container 42.

The container assembly 40 is particularly well-suited for collecting and pooling fluids, particularly in environments in which sterility is an important consideration both before and after collection. Because of this, the assembly 40 will be discussed herein in the context of the pooling of plasma for fractionation purposes. However, it should be appreciated that the assembly 40 is well-suited for use in other diverse operative environments.

Figure 7:
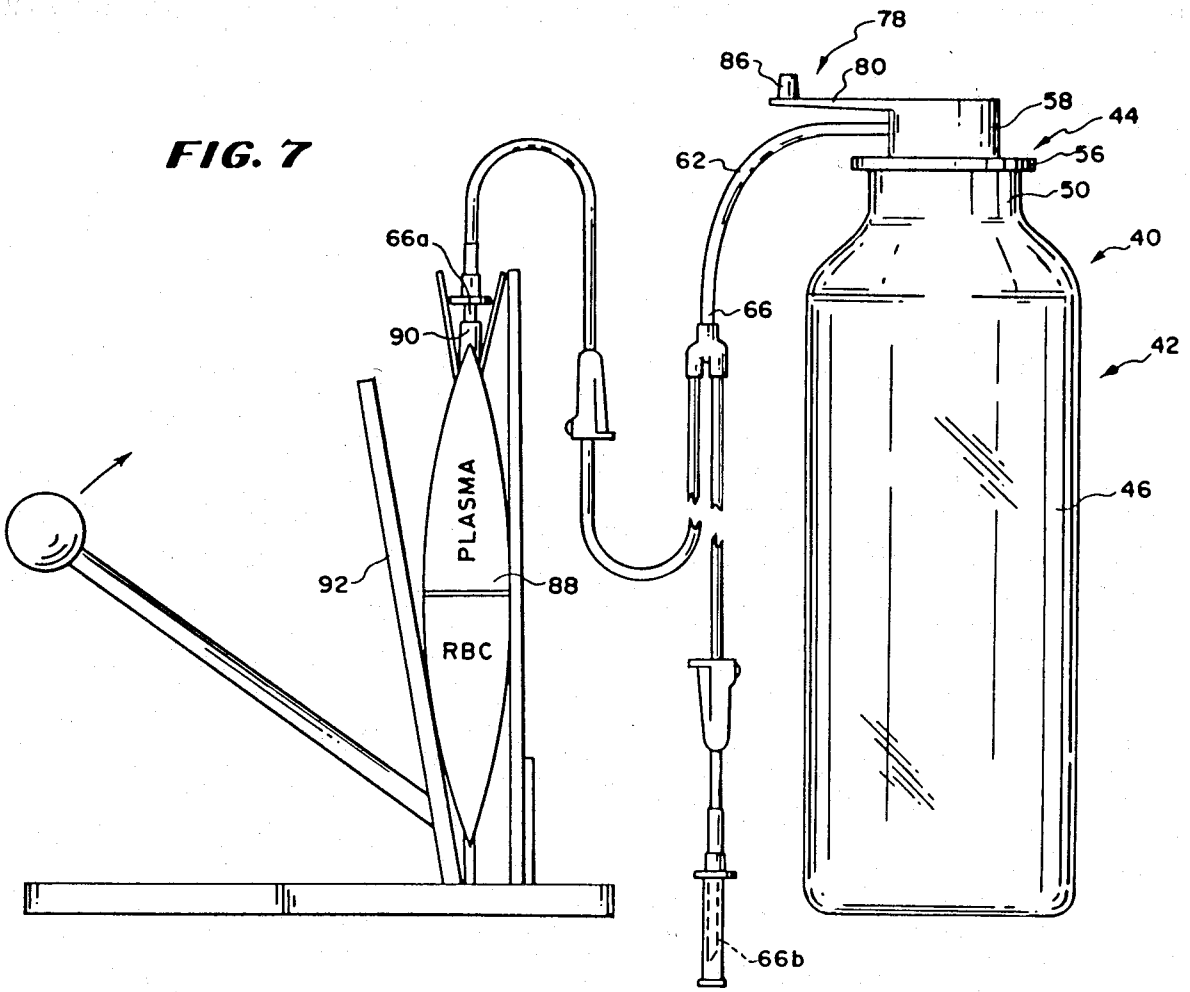
FIG. 7 is an assembled elevation view of the container assembly shown in FIG. 4, with plasma being transferred into the assembly through the attached transfer set.

As is best shown in FIGS. 4 and 7, the container 42 of the assembly 40 includes a body 46. The body 46 in the illustrated embodiment has a cylindrical, or bottle-like, configuration. However, other configurations may be used, depending upon the particular operative environment.

The body 46 peripherally defines an open interior 48 for receiving fluids. The body 46 also includes a neck 50 having a port 52 which communicates with the open interior 48. A lip 51 peripherally encircles the port 52.

The container 42 may be variously constructed. In the illustrated embodiment, the container 42 is preferably made of a generally rigid, self-supporting plastic material which can be formed into the desired bottle-like shape utilizing conventional techniques, such as injection molding or blow molding. Other materials, such as glass or metal, could be also used, again depending upon the particular demands of the given operative environment.

In the illustrated embodiment, because the container 42 will be used for the collecting and pooling of plasma, the container body 46 is preferably made of a hemocompatible plastic having a relatively high low-temperature strength to withstand temperatures at or near '80° C., such as high density polyethylene or polypropylene. The pooled plasma can be frozen at these temperatures within the container interior 48 for shipment and storage prior to fractionation.

Also in the context of a plasma pooling container, the body 46 of the container 42 preferably has smooth interior walls to facilitate the removal of the plasma in frozen or semi-frozen form, if desired.

Figure 5:
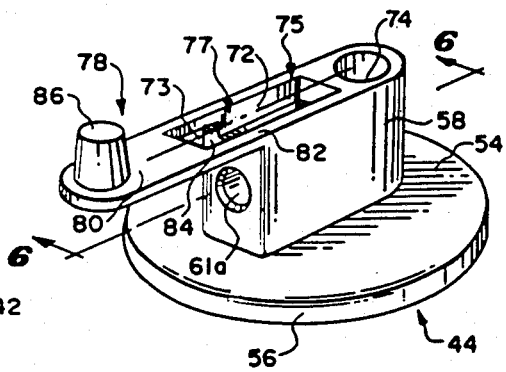
FIG. 5 is a perspective view of the cap assembly associated with the container assembly shown in FIG. 4.
Figure 6:
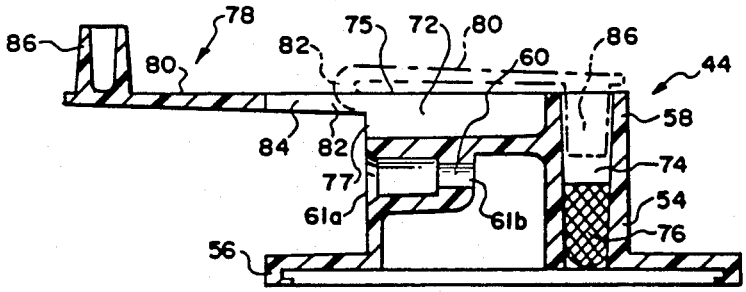
FIG. 6 is a side section view of the cap assembly taken generally along line 6—6 in FIG. 5.

As can best be seen in FIGS. 5 and 6, the cap assembly 44 includes a body 54 which is operative for sealing engagement with the port 52 of the container 42. To accommodate this arrangement, in the illustrated embodiment, the cap body 54 includes a rim 56, which engages the lip 51, and a top 58 which projects upwardly from the rim 56.

As can best be seen in FIG. 6, the cap assembly 44 further includes means for defining a fluid path 60 through the body 54. When the cap body 54 is properly positioned on the neck 50 of the container 42, the path 60 communicates, at one end 61*a*, with the atmosphere and, at the other end 61*b*, with the interior 48 of the container 42.

A length of tubing 62 can be attached by various means to the cap body 54 in communication with the end 61*a* of the fluid path 60. The tubing 62 can this form an integrally connected part of the assembly 40.

Figure 8:
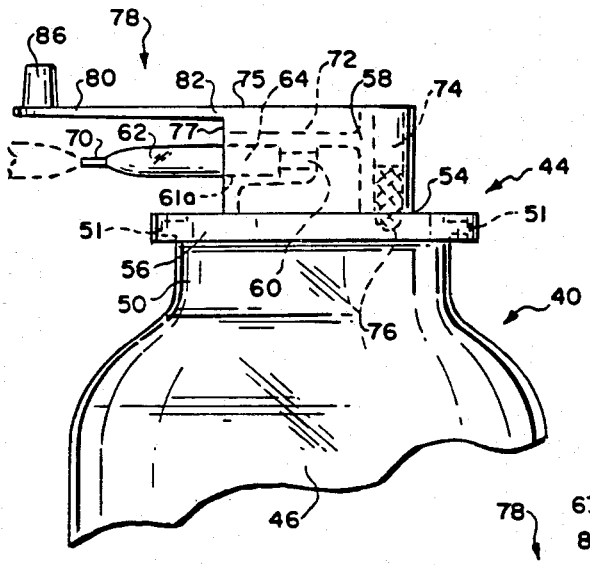
FIG. 8 is an assembled elevation view of the cap assembly of the container assembly shown in FIG. 4, after the associated plasma transfer set has been heat sealed closed and severed.

In the illustrated embodiment, the tubing 60 is made of a thermoplastic, hemocompatible material, such as plasticized polyvinyl chloride. As best shown in FIGS. 4 and 8, one end 64 of the tubing 62 is sealingly secured to the end 61*a* of the fluid path 60. The other end 66 of the tubing 60 (see, in particular, FIGS. 4 and 7)includes a pair of pointed spike members 68*a* and 68*b*.

In an alternate arrangement (not shown), the tubing end 66 can be integrally connected to another blood component collection container. The container assembly 40 can thus form a part of a closed, multiple container blood collection system, such as shown in Bacehowski et al U.S. Pat. No. 4,253,458 or Smith U.S. Pat. No. 4,222,379.

In yet another alternate embodiment (also not shown), the tubing end 66 can include one or more sterile connectors, such as disclosed in Granzow et al, U.S. Pat. Nos. 4,157,723, 4,265,280, or 4,340,097. By coupling these connectors to matching connectors a sterile fluid path into the container 42 can be formed.

Like the container body 46, the body 54 may be variously constructed. However, in the illustrated embodiment, the body 54 is made of a plastic material formed into the desired shape by conventional means, such as by injection molding. The body material is preferably compatible with the plastic material used for the container 42, so that the rim 56 of the cap body 54 may be sealingly secured on the container neck portion 50 by heat sealing, sonic molding, spin welding, or the like.

Preferably, the material for the cap body 54 is also compatible with polyvinyl chloride plastic, so that the end 64 of the polyvinyl chloride tubing 62 can be solvent bonded to the end 61*a* of the fluid path 60. A secure, integral connection between the cap body 54 and the tubing 62 is thus possible. Alternately, a mechanical bond between the tubing end 64 and the fluid path end 61*a* can be used.

In the illustrated embodiment, the cap body 54 is preferably made of a preselected blend of plastics which include from 50 to 75 percent by weight a polyolefin material and from 25 to 50 percent by weight of a flexible block copolymer of covalently bonded polybutylene terephthalate units and poly(1,4-butylene) oxide units. Such a blend is disclosed in Kwong et al U.S. Pat. No. 4,327,726, or in copending Kwong et al U.S. patent application No. 299,481 (filed Sept. 14, 1981) , entitled CONNECTOR MEMBER FOR DISSIMILAR MATERIALS.

This blended plastic material can be sonic welded to high density polyethylene. In the context of the illustrated embodiment, an encapsulation process is preferred. During encapsulation by sonic welding, the rim 56 of the cap body 54 flows around and under the lip 51 (see FIG. 8) to both mechanically and chemically secure the cap body 54 to the container 42.

The blended plastic material is also readily solvent bondable to the polyvinyl chloride tubing 62.

In the particular operative environment of the illustrated embodiment (see, in particular, FIG. 8), after plasma has been introduced into the container 42, the end 66 of the tubing 62, and with it both spike members 68*a* and 68*b*, will eventually be separated from the container assembly 40. The tubing 62 will also be sealed at the point of separation, leaving a sealed end portion 70 attached to the cap body 54. This portion 70 provides a fluid-tight seal for the assembly 40.

It is highly desirable to protect the sealed end portion 70 from inadvertent damage during handling of the assembly 40. Such damage could compromise the fluid-tight seal and jeopardize the sterile integrity of the contents of the container 42.

Therefore, in accordance with the invention, the cap assembly 44 includes means defining a pocket 72 in the body 54 for therein selectively enclosing the sealed end portion 70 of the attached tubing 60.

The pocket 72 may be variously configured and located on the cap body 54. In the illustrated embodiment, as best shown in FIGS. 5 and 6, the pocket 72 is formed in the uppermost surface of the top 58 of the cap body 54 and extends axially above the fluid path 60.

The pocket 72 includes an open top 75 and an open end 77. The open end 77 is disposed adjacently above the end 61*a* of the fluid path 60 to which the tubing 62 is attached.

Figure 9:
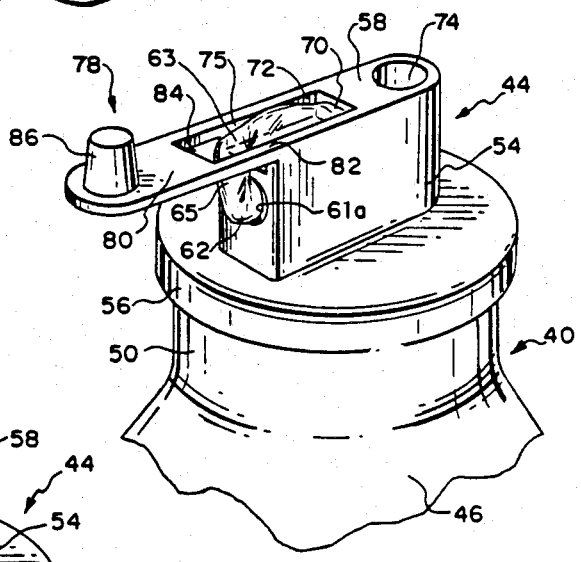
FIG. 9 is a perspective view of the cap assembly of the container assembly with the sealed tubing end disposed in the protective pocket of the cap assembly and the cover member in its opened position.

As can be seen in FIG. 9, the sealed end portion 70 can be bent back through the open top 75 and open end 77 and laid into the pocket 72. This backward bending movement forms a crimp, or occlusion, in the portion 63 of the tubing 70 which extends through the open end 77. This crimped portion 63 serves as an additional fluid-tight seal which supplements the already formed fluid-tight seal at the tubing end 70.

Furthermore, by applying a moderate pulling force upon the tube end 70 as it is being laid back into the pocket 72, the section 65 of tubing 70 which extends between the end 61*a* of the fluid path and the crimped portion 63 can be conveniently moved into tight overlying engagement against the vertical wall of the cap top 58. The vulnerability of this section 65, which lies outside the pocket 72 and is thus somewhat exposed, is nevertheless minimized to the fullest extent possible.

To further facilitate the pulling of the tube end 70 into the pocket 72, thereby pulling the section 65 snugly against the cap top 58, the open end 77 of the pocket 72 can be beveled as it enters the pocket 72.

The open interior of the pocket 72 is preferably sized to accommodate the sealed end portion 70 of the tubing 62 in a tight, friction fit. The end portion 70 of the plasticized tubing 62 can thus be tightly and securely lodged within the pocket 72 (see FIG. 9).

The cap assembly 44 also includes vent means 74 which, in the illustrated embodiment, takes the form of a generally vertically disposed passage extending through the top portion 58 of the body 54 adjacent to the pocket 72.

A filter member 76 (see FIGS. 4, 6, and 8) is preferably press-fitted within the vent passage 74. The filter member 76 permits the passage of air but blocks the passage of bacteria. The sterility of the interior of the container 42 is thus maintained.

While the filter member 76 may be variously constructed, in the illustrated embodiment, it takes the form of a plug of a sintered microporous polyethylene available under the trademark "POREX" from the Glassrock Products, Inc. of Fairburn, Georgia.

The cap assembly 44 also preferably includes cover means 78 which is movable relative to the cap body 54 between a first position (see, for example, FIG. 9) which opens the pocket 72, and a second position (see, for example, FIG. 10) which closes the pocket 72.

While the cover means 78 may be variously constructed, in the illustrated embodiment, the cover means 78 includes a resilient, generally flat tab member 80 which extends outwardly beyond the top 58 of the cap body 54 along the axis 73 of the pocket 72 (see, in particular, FIG. 5). The tab member 80 is positioned generally above the end 61*a* of the fluid path 60. Preferably the tab member 80 is formed as an integral part of the cap body 54.

The resilient tab member 80 includes a plastic hinge portion 82 (see FIGS. 6, 8, and 10) along which the member 80 can be moved relative to the cap body 54 between the heretofore described first and second positions. Preferably, the hinged portion 82 is located a short distance outwardly of the physical junction of the tab member 80 and the cap top 58.

Also preferably, the hinge portion 82 resiliently biases the tab member 80 toward the first position, as shown in FIGS. 4 and 7.

An opening 84 (see FIG. 5) is formed in the tab member 80 in the region of the plastic hinge portion 82. As shown in FIG. 9, when the tab member 80 is disposed in its normally biased first, or opened, position, the sealed end 70 of the tube 62 can be conveniently passed through the opening 84 and folded back into the pocket 72 in the manner just described.

Subsequent movement of the tab member 80 to its second, or closed, position (see FIG. 10) serves to close the open top 75 of the pocket 72. The sealed end portion 70 can thus be completely enclosed within the confines of the pocket 72.

Furthermore, in the preferred embodiment, because the hinge portion 82 is positioned a short distance outwardly of the cap body 54, when the tab member 80 is in its second, or closed, position (see FIG. 10), the hinge portion 82 overhangs the exposed tubing section 65 which is snugly engaged against the cap body 54. This snugly-engaged section 65, although extending outside of the pocket 72, is further shielded from inadvertent contact.

Figure 11:
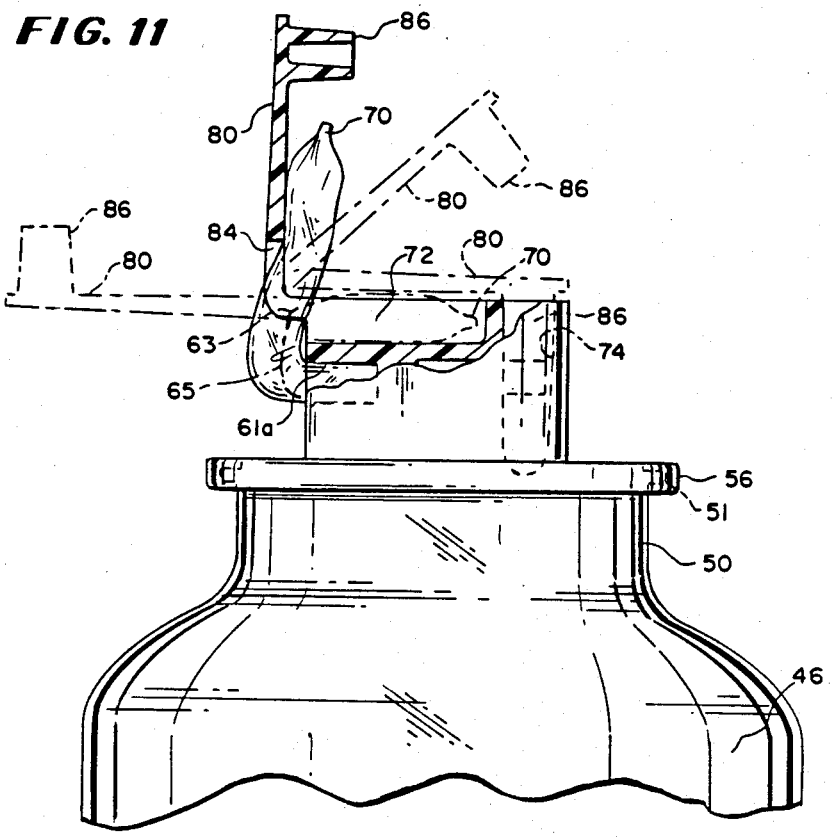
FIG. 11 is a view of the cap assembly of the container assembly showing the closure of the cover member to lodge the sealed end in the protective pocket.

As can be seen in FIG. 11, closure of the tab member 80 can in and of itself serve to move and lodge the sealed end portion 70 into the pocket 72. The user can thus conveniently enclose the end portion 70 within the pocket 72 quickly and with a minimum of effort.

The tab member 80 preferably also includes a plug member 86 disposed at its outermost end. The plug member 86 is positioned to engage the vent passage 74 when the tab member 80 is placed into its second position (see FIGS. 6 and 10). By virtue of this construction, the tab member 80 can be securely retained, when desired, in its second, or closed, position.

Preferably, the plug member 86 makes a hermetic interference fit within the vent passage 74. The interior of the vent passage 74 and the exterior of the plug member 86 can be correspondingly tapered to promote this interference fit and the resulting hermetic seal.

Reference is now made to FIGS. 7 through 10, which illustrate the use of the just described container assembly in the context of a typical plasma pooling procedure.

During conventional plasmapheresis, a unit of whole blood is collected in a bag 88 (see FIG. 7) which is centrifuged to separate the whole blood into red blood cells (abbreviated RBC in FIG. 7) and plasma. As shown in FIG. 7, with the tab member 80 situated in its normally biased first, or opened, position, one spike member 68*a* of the transfer set tubing 62 is inserted into an outlet port 90 of the bag 88 having a piercable membrane. The plasma is expressed into the interior 48 of the container 42 by using, for example, a manual plasma expelling device 92.

The red blood cells remaining in the bag 88 are returned to the donor.

Typically, another unit of whole blood is collected from the same donor into another bag (not shown) and centrifugally separated into red blood cells and plasma. The second unit of plasma is expressed into the container 42 using the second spike member 68*b*. The remaining red blood cells are again returned to the donor.

Upwards to 900 milliliters of plasma can be pooled from a single donor into the container 42 using this procedure. The container interior 48 is sized to comfortably accommodate this maximum anticipated volume.

As shown in FIG. 8, after the two units of plasma have been pooled in the container 42, the transfer tubing 62 is hermetically sealed closed and severed as close as possible to the cap body 54. A HEMATRON ® dielectric sealer manufactured and sold by the Fenwal Division of Travenol Laboratories, or a comparable dielectric sealer, can be used for this purpose.

The sealed end portion 70 remains attached to the cap body 54.

As shown in FIG. 9, the sealed end portion 70 can be passed through the opening 84 of the tab member 80 and pressed into the pocket 72, where it is securely retained by virtue of the friction fit.

Figure 10:
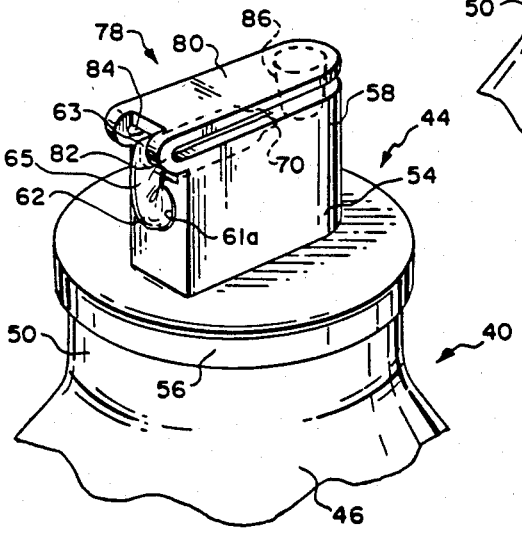
FIG. 10 is a perspective view of the cap assembly of the container assembly with the cover member closing the protective pocket while at the same time hermetically sealing the vent of the cap assembly.

As shown in FIG. 10, the tab member 80 can then moved into its second, or closed, position to move the plug member 86 into the vent passage 74. This movement simultaneously hermetically seals the vent passage 74, and thus the entire assembly 40.

As before explained, and as shown in Fig. 11, the last two operations can be accomplished in a single convenient step.

The container assembly as shown in FIG. 10 can be frozen, shipped, stored, and processed as a compact, hermetically sealed unit.

Because the sealed end portion 70 remains enclosed within the confines of the pocket 72, it is effectively shielded during subsequent handling from inadvertent damage.

Furthermore, because the vent passage 74 remains hermetically sealed, the container assembly 40 shown in FIG. 10 can undergo complete water bath immersion to thaw the plasma quickly and completely in a relatively short period of time.

The invention thus serves to protect the sterile integrity of the container assembly 44 during handling. At the same time, the invention facilitates faster and more efficient fractionation procedures.

Various of the features of the invention are set forth in the following claims.

We claim:

1. A container assembly in which a parenteral fluid has been collected comprising a container having an interior in which the parenteral fluid is carried and a port communicating with the interior, and a cap including a body engaged with said container port, means for defining in said body a normally open vent passage which includes therein filter means for permitting the passage of air and for preventing the passage of bacteria, means for defining a fluid path through said body having one end communicating with the atmosphere and an oppositely spaced end communicating with said container interior, wall means for defining in said body the confines of an elongated pocket which extends parallel to said fluid path and which includes an open end disposed adjacent to said one fluid path end, flexible tubing attached to said one fluid path end, said tubing having had an initial length when the parenteral fluids were introduced into said container interior and now having been sealed and severed in close proximity to said one fluid path end to form a sealed length which is shorter than said intial length, one portion of said sealed length of tubing extending in tight overlying engagement against said cap body from said one fluid path end through said open end of said pocket to form a crimp in said tubing length at said open pocket end, the remaining portion of said sealed length of tubing extending from said crimped portion into said confines of said pocket, said pocket wall means being further operative for frictionally retaining said remaining portion of tubing within said confines of said pocket and for shielding said remaining portion of tubing from contact within said confines of said pocket, and cover means attached to said cap body for movement between a normally biased first position spaced away from said vent passage to open said vent passage and allow the introduction of parenteral fluid into said container interior and a second position in said vent passage to hermetically close said vent passage and, together with said crimped sealed length of tubing retained in said pocket, hermetically seal the parenteral fluid within said container interior.

* * * * *